United States Patent [19]

MacKinnon

[11] 4,365,675

[45] Dec. 28, 1982

[54] PILE DRIVING ASSEMBLY

[75] Inventor: Alan G. MacKinnon, Newcomerstown, Ohio

[73] Assignee: Foundation Equipment Company, Newcomerstown, Ohio

[21] Appl. No.: 78,456

[22] Filed: Sep. 24, 1979

[51] Int. Cl.[3] ..... B25D 17/28; E21B 1/00

[52] U.S. Cl. ..... 173/105; 173/130; 175/85; 405/232

[58] Field of Search ..... 173/112, 105, 134, 130, 173/104, 90, 81, 89, 86, 31; 175/85, 195; 269/56, 57, 58; 405/232

[56] References Cited

U.S. PATENT DOCUMENTS

| | | | |
|---|---|---|---|
| 299,086 | 5/1884 | Over | 173/90 |
| 2,744,726 | 5/1956 | Comeaux | 175/195 X |
| 3,827,508 | 8/1974 | MacKinnon | 175/85 X |
| 3,892,107 | 7/1975 | Handen et al. | 173/104 X |
| 4,134,460 | 1/1979 | Klemm | 173/104 X |

*Primary Examiner*—Werner H. Schroeder
*Assistant Examiner*—Andrew M. Falik
*Attorney, Agent, or Firm*—Squire, Sanders & Dempsey

[57] ABSTRACT

A pile driver assembly comprising a lead, a hammer supported for longitudinal movement along the lead, a helmet at the lower end of the lead configured to receive the end of a noncircular pile, a pile guide supported for longitudinal movement along the lead and having a cross-section configured to receive the pile, and a pile rotator supported near the lower end of the lead and configured to receive the pile, the pile rotator centering and rotating the noncircular pile.

7 Claims, 6 Drawing Figures

FIG. 1
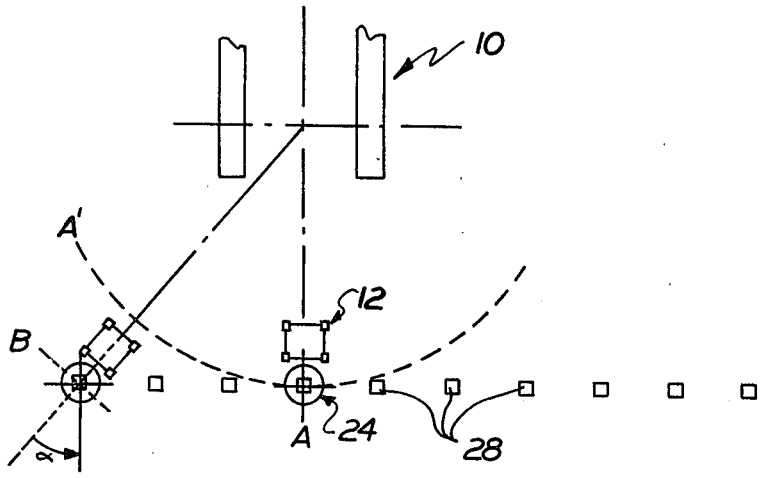
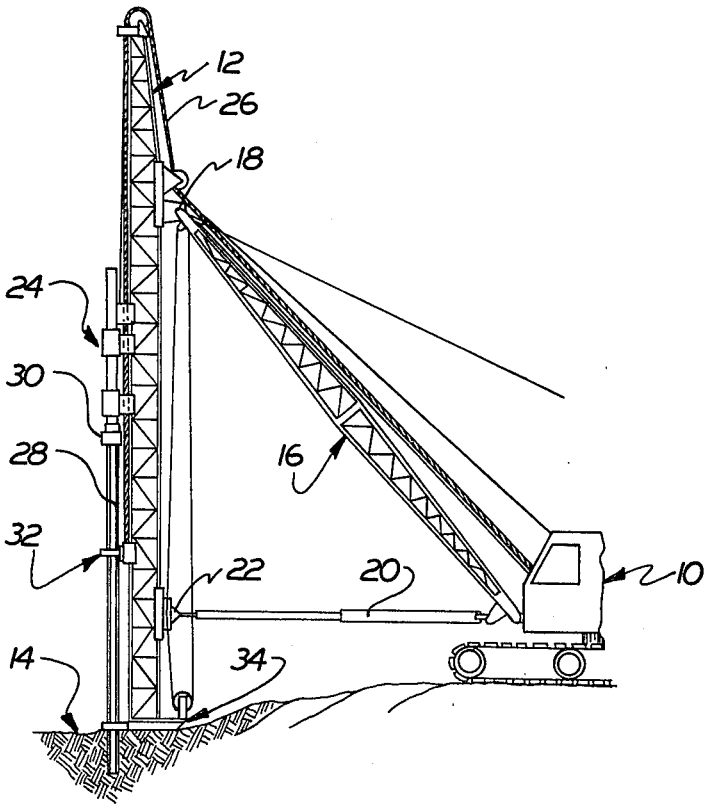
FIG. 2

PILE DRIVING ASSEMBLY

BACKGROUND OF THE INVENTION

1. Field of the Invention

The present invention relates generally to pile driving apparatus. More specifically, the present invention relates to an improvement in pile driving apparatus whereby a noncircular pile may be centered and rotated.

2. Description of the Art

Pile driving apparatus have long been used in the construction industry for installing foundations and the like. All varieties of piles are employed in this regard, exemplary of which are wooden, steel, and concrete piles. Likewise, the piles may have various cross-sectional configurations; and, for purposes of the present invention, these may be divided between circular and noncircular geometries. Those of interest herein are noncircular, and include, for example, square, rectangular, triangular, octagonal, I and T.

Conventional pile driving apparatus are comprised of a lead, which is positioned adjacent the location for driving the pile by a crane or other suitable device. The lead extends upwardly from the foundation area to provide a carriage for a pile driving hammer. A pile is positioned at the foundation site beneath this hammer, and the latter impacts upon the former to drive it into the foundation area.

A substantial improvement in the operational efficiency of pile driving apparatus has been made by the present inventor, in regard to those inventions disclosed and claimed in U.S. Pat. No. 3,827,508. These inventions concern a pile positioning apparatus (hereinafter referred to as a "pile guide") which serves to properly position the pile beneath the pile driving hammer. Prior to the invention of the pile guide, it was necessary to manually position the upper end of the pile within the helmet of the hammer. This process was time consuming, difficult, and oftentimes dangerous. The pile guide simplifies this procedure in the sense that it urges the pile into proper engagement with the helmet and is controlled by the crane operator from his remote position. For further details on the structure of these pile guides, reference is made to the aforementioned United States patent, which is incorporated herein and relied upon.

Pile driving apparatus also conventionally include a foot yoke located proximate the lower end of the lead. A foot yoke, and its associated structure, serves to position the lower end of a pile at the proper location and guide the same as the pile is being driven into the foundation area.

There have been many refinements in the structure utilized for pile driving apparatus over the years. Accordingly, these tasks have been materially simplified and made much more efficient. However, while the driving of a single pile has been so improved, most construction jobs require the driving of a series of piles which must be carefully located along a given line; usually, a straight line. Therefore, the lead must be repositioned by the crane to consecutive locations corresponding to the overall foundation area. This may be further complicated if the lead is carried on a locomotive crane or a barge-mounted crane, where mobility is not only restricted to a great degree but repeated movement of the crane is highly undesirable.

This problem is exacerbated when piles having a noncircular cross-section are employed. Although the lead may be moved by the crane to a limited extent from one location to the next and the hammer properly positioned over the pile, for any cross-section but circular the pile will have the wrong cross-sectional orientation. This is, obviously, unacceptable.

To date, three solutions to this problem have been proposed and employed in the installation of noncircular piles. The crane and lead are moved. The lead itself is rotated. The pile has been manually rotated and restrained by a specially-constructed template, which is otherwise independent of the pile driving apparatus. None of these, nor a combination of them, is totally satisfactory.

SUMMARY OF THE INVENTION

The present invention overcomes the problem of driving a line of noncircular piles where it is desired to maintain the location of the crane utilized to support the lead and pile driving equipment. This is achieved, in its most essential aspects, by including a pile rotator which serves to center and rotate a noncircular pile about its longitudinal axis. In this manner it is possible to maintain the position of the crane from one pile location to the next and properly orient the pile both vertically and horizontally over the corresponding span. Control for the pile rotator is made through an appropriate linkage to the crane, whereby the crane operator may achieve the proper orientation from his remote location. Preferably, the pile is rotated by applying a torque at the lower end which is transmitted through the pile, and the other components of the pile drawer assembly engaging the pile are slaved for rotation through the pile itself.

For a fuller understanding of the present invention and other advantages resulting therefrom, reference is made to the following detailed description of preferred embodiments, taken in conjunction with the figures of drawing, wherein:

BRIEF DESCRIPTION OF THE DRAWINGS

FIG. 1 is a pictorial illustration of a pile driving apparatus and a series of piles lying in a straight line;

FIG. 2 is a side elevational view of a pile driving apparatus;

DETAILED DESCRIPTION OF PREFERRED EMBODIMENTS

Figure 3:
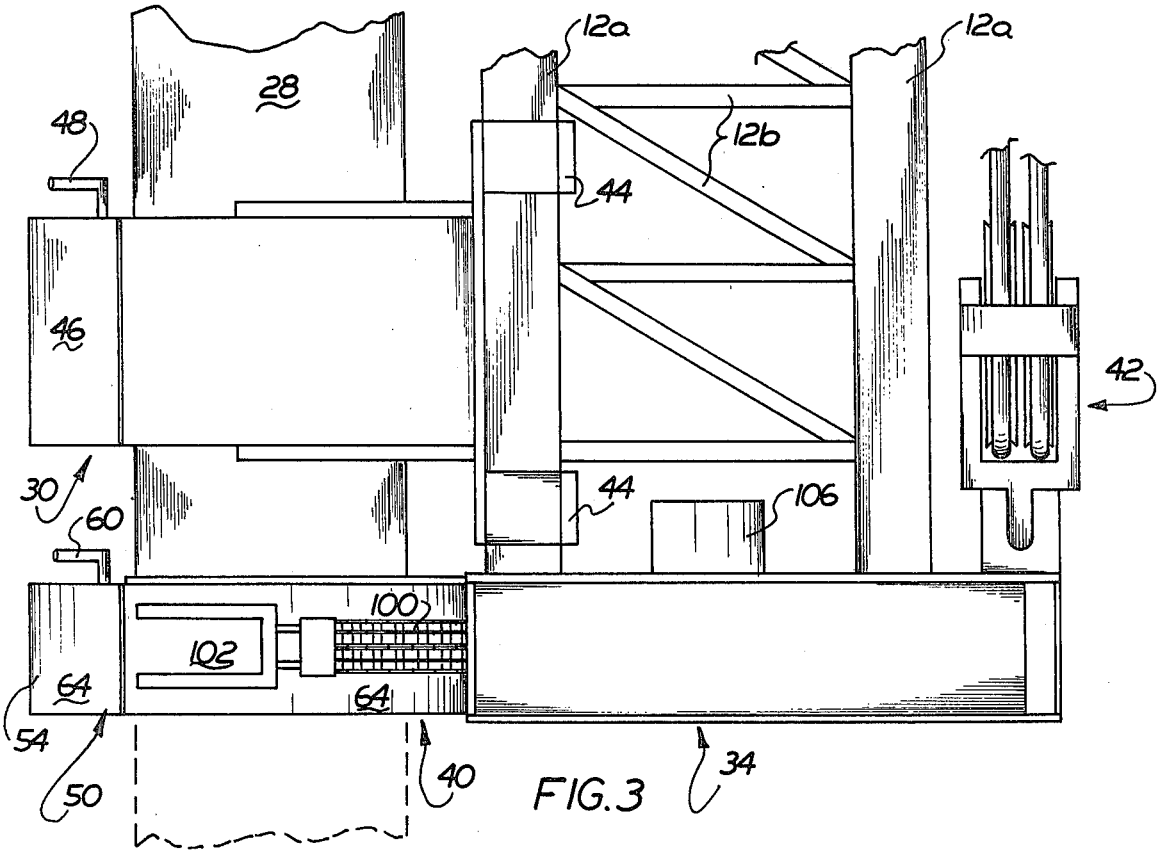
FIG. 3 is a detailed, fragmentary side elevational view of the lower portion of the lead of a pile driving apparatus, showing a pile guide in a lowered position, and the pile rotator of the present invention.

In order to more fully elucidate upon the various advantages of the present invention, the following detailed description will be given in terms of various preferred embodiments thereof. The skilled artisan will appreciate, however, that the same are meant to be illustrative only, and are in no way limitative.

The present invention concerns improvements in pile driving apparatus. Generally speaking, the principal improvement provided by the present invention is the ability to drive a straight or generally straight line of noncircular piles with minimal movement of the crane utilized to position and support the pile driving structure.

The problem to be overcome is illustrated in FIGS. 1 and 2. A crane, designated generally as 10, supports a lead, designated generally as 12, in a substantially vertical orientation above a foundation area designated generally as 14. The crane 10 includes a boom 16 which attaches to the lead 12 at a pivot 18. Typically, the pivot 18 is a cross-tube or two-way joint allowing for two degrees of motion. A lower auxiliary boom, or kicker, 20 extends from the crane 10 to a slide member 22 at the lower end of the lead 12.

The lead 12 provides a carriage or guideway for a pile driving hammer, designated generally as 24. The hammer moves in a longitudinal direction along the lead, the position of which is controlled from the crane 10 via cables, such as 26. The hammer includes a helmet 30 at the lower terminus thereof, which is internally configured to mate with the upper end of pile 28. For example, the internal geometry of the helmet 30 will have a generally square configuration if the pile cross-section is square, rectangular for a rectangular pile, etc. The principal function of the helmet 30 is to restrain the upper end of the pile beneath the impact area of the hammer 24 and, apart from this, may take any suitable configuration for achieving this purpose.

As shown in FIG. 2, the pile driving apparatus also includes a pile guide, designated generally as 32, such as that disclosed in the present inventor's U.S. Pat. No. 3,827,508. The pile guide 32 is supported for longitudinal movement along lead 12. When the pile 28 is first picked up by the crane it has a tendency to lean; and it was formerly very difficult to properly position the pile within the helmet 30. The pile guide simplifies this procedure by aligning the pile 28 for engagement with the helmet. This is achieved by securing the pile guide to the pile near the lower end, and then moving the pile guide upward along the lead. This pulls the pile into proper orientation with respect to the lead itself and, hence, the helmet 30.

The pile driver shown in FIG. 2 also includes a foot yoke 34. The foot yoke is generally positioned at or near the lower end of the lead and serves to center the pile 28 at the proper location, and guide the pile during the driving procedure. For this purpose, a foot yoke typically is a structure having a central opening configured to mate with the pile 28.

When driving a straight line or substantially straight line of piles 28, as illustrated in FIG. 1, it has heretofore been necessary to repeatedly reposition the crane 10 in order to achieve proper orientation of noncircular piles. As used herein, orientation of the pile means the orientation of the cross-sectional faces whether the pile be vertical or battered. Accordingly, proper positioning of a noncircular pile requires it to be rotated about its longitudinal axis to provide the necessary orientation.

When the boom 16 extends directly out from the crane 10, to the position shown as A in FIG. 1, a noncircular pile 28 may be driven in proper orientation with little difficulty. As further piles are required to be driven, the boom 16 will swing in a circular arc described by the dashed line A–A'. The lead 12 may be moved outwardly by means of appropriate manipulation of the booms 16 and 20 so that a pile can be driven at a desired point, such as that denoted B. However, where a noncircular pile is to be positioned for driving at point B, the orientation of the pile cross-section will be rotated by an angle, denoted $\alpha$. This is unacceptable. Without some means to properly orient the cross-section of the pile 28, it is necessary to reposition the crane and/or the lead and/or the pile, so that the desired orientation may be achieved. This repositioning is not an easy task under any circumstances.

The present invention eliminates this problem by providing suitable apparatus for rotating the pile 28 by the desired angular amount corresponding to $\alpha$ in FIG. 1. This is accomplished by a pile rotator, designated generally as 40 and shown in detail in FIGS. 3–5.

Figure 5:
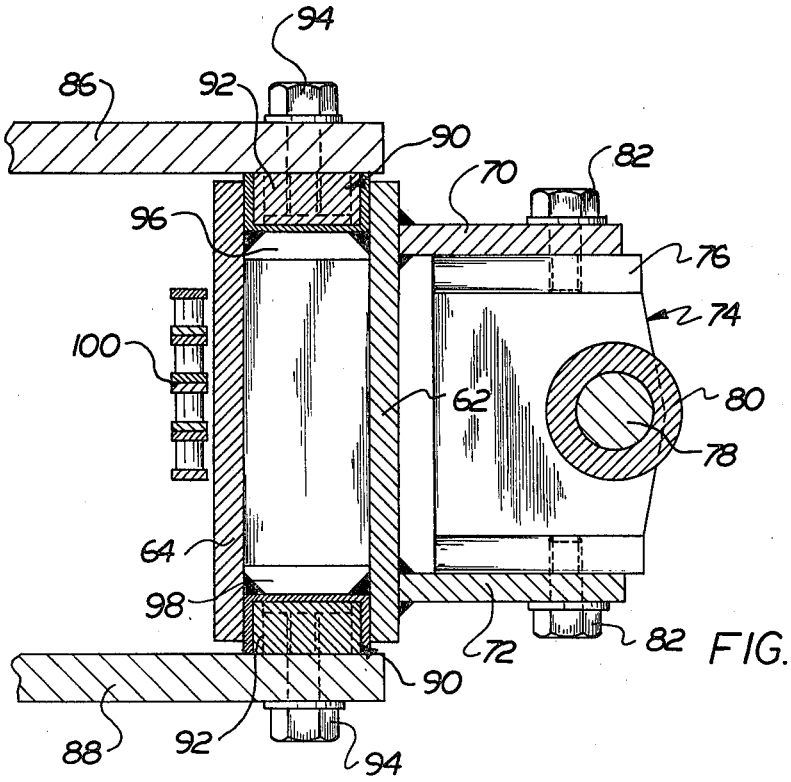
Figure 4:
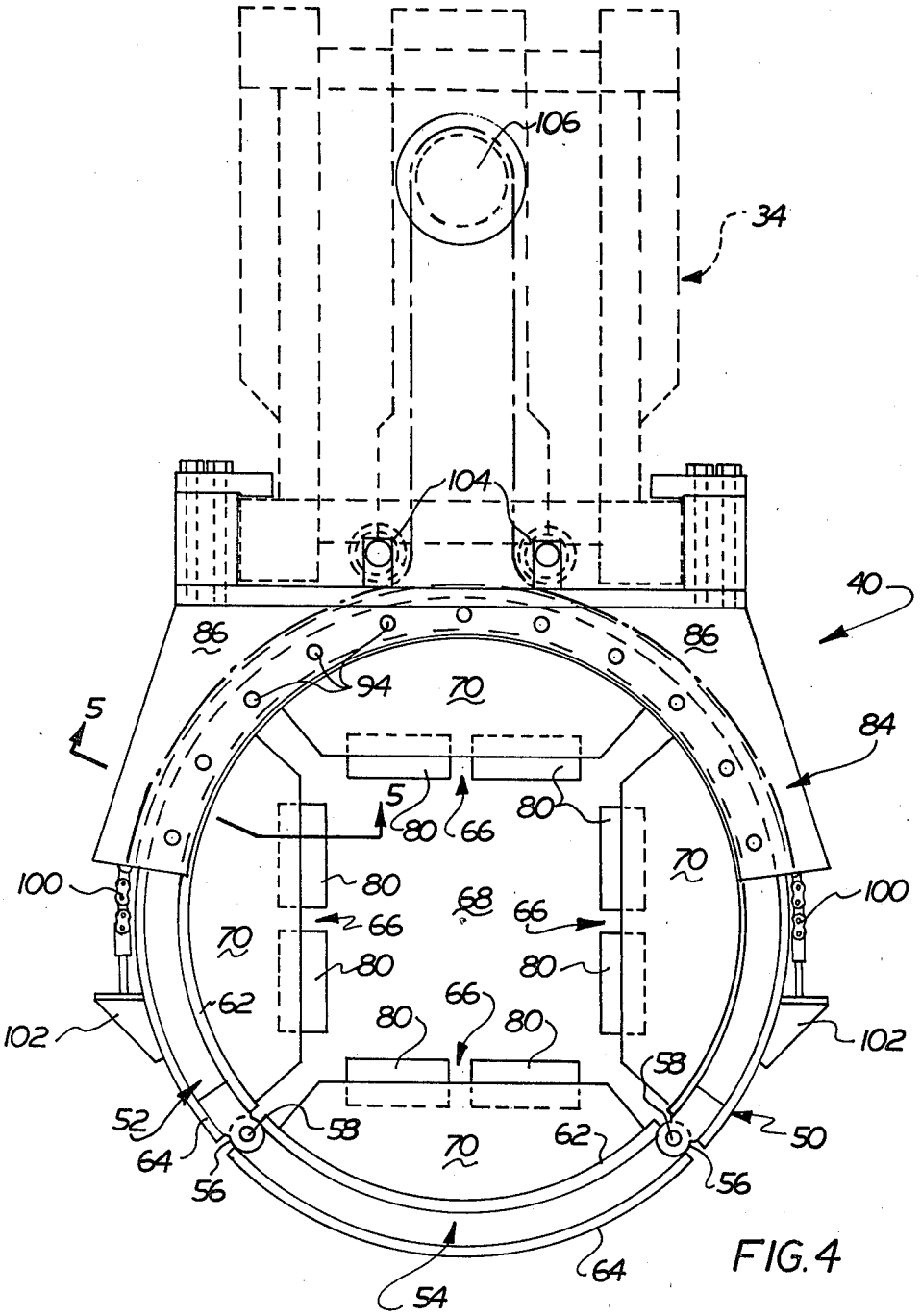
FIG. 4 is a top plan view of the pile rotator of the present invention; and, FIG. 5 is a sectional view, taken substantially along the lines 5—5 of FIG. 4.

Referring specifically to FIGS. 3–5, a pile 28 is shown to be guided by the pile guide 32 and the pile rotator 40, both of which are secured to the lead 12. The lead 12 is shown to be comprised of vertical post members **12*a* and cross braces 12*b* which stabilize the same. The lead 12 terminates at the foot yoke 34, to which the pile rotator 40 is attached. A pulley system 42 is also secured to the foot yoke 34, which cooperates with cables extending from the crane 10** in order to control the various individual components comprising the pile driver assembly.

The pile guide 32 is, itself, guided for longitudinal movement along the lead 12 by slide members 44. The pile guide extends outwardly from these slide members and around the pile 28 securing the same to the lead 12. The pile guide 32 includes a front gate 46 which may be opened by means of a handle or lever 48 to permit access to an internal opening within the pile guide. This internal opening has a geometry which corresponds to that of the pile 28 and, for purposes of the present invention, will be noncircular. To permit a wide range of adaptability, the internal geometry of the pile guide 32 may be varied by the use of suitable inserts (not shown).

The pile guide 32 is shown in FIG. 3 in its lowest position. After the pile guide has been secured around the pile 28, it will be raised by means of a cable extending from the crane 10 and thereby guide the pile 28 into engagement with the helmet 30. Accordingly, the pile guide will always assume a position intermediate this helmet and the pile rotator 40.

The pile rotator 40 is comprised of a ring beam 50, best viewed in FIG. 4. The ring beam 50, which is a substantially cylindrical member as shown in the drawing, is segmented in this preferred embodiment; in the sense that it is divided into a major segment 52 and a gate segment 54. The gate is attached to the segment 52 at hinge elements 56. The purpose of the hinge elements 56 is to permit the opening or removal of gate 54 in order to position a pile internally of the pile rotator, as described more fully hereinbelow. Consequently, the structure of the hinge elements 56 may vary widely, provided it is capable of performing this function. As shown in figures of drawings, the hinge elements 56 are comprised of registering bores 58 through the ends of each of the segments 52 and 54, and a handle-like pin member 60, best viewed in FIG. 3, inserted through these registering bores.

Figure 6:
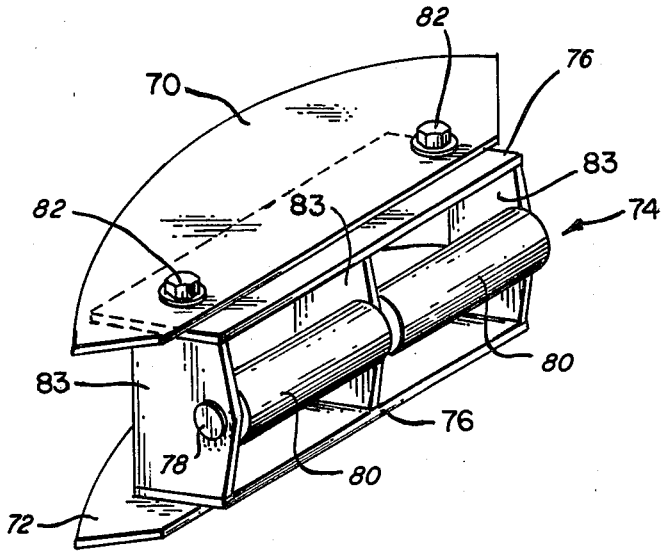
FIG. 6 is a perspective view of a portion of the pile rotator of the present invention.

Each of the segments 52 and 54, are shown to be fabricated from inner and outer metal plates 62 and 64, respectively. A plurality of roller guides 66, four of which are shown in FIG. 4, project within the ring beam 50 from the inner wall 62. These roller guides 66 define an opening 68 which corresponds in geometry with the cross-section of the pile 28. In order to accommodate various sizes and shapes of piles, the roller guides 66 are removable in order that alternate configurations may be provided. For this purpose, a pair of plates 70 and 72 are welded or otherwise secured to the inner wall 62, as best viewed in FIG. 5. A channel is provided between these plates 70 and 72 within which a roller guide insert 74 may be positioned. The roller guide inserts 74 are each comprised of a generally rectangular frame member 76 which includes a pair of axle members 78. Rollers 80 are disposed on the axles for rotation thereabout. The frame 76 is secured within the channel by means of bolts 82 or other suitable fasteners. In FIG. 6, the assembly of plates 70 and 72 to one of roller guide inserts 74, including frame members 76, three transverse frame members 83, and axle 78, is shown. A pair of rollers 80 are disposed on axle 78.

The ring beam 50 is rotatably received within a fixture 84 which is secured to the foot yoke 34. The fixture 84 is comprised of upper and lower metal plates 86 and 88, respectively, which provide a channel within which the ring beam may rotate. Ring beam guide means 90, best viewed in FIG. 5, insure proper alignment of the ring beam 50 within the channel defined between plates 86 and 88. The guide means 90 are comprised of a metal strip 92 which is bolted or otherwise secured to the upper and lower plates 86 and 88 by means of bolts 94 or other suitable fasteners. The guide strip 92 projects within upper and lower channels 96 and 98, respectively, formed between the inner and outer plates 62 and 64 of the ring beam 50.

A drive means is provided to cause the ring beam 50 to rotate within the channel of fixture member 84. This drive means is shown to be comprised of a chain 100 which is secured at each of its end to blocks 102 on the segment 52, as best viewed in FIG. 4. The chain passes within the channel of fixture member 84 in engagement with a pair of idler sprockets 104 located in the foot yoke 34, and thence to a driving mechanism 106. The driving mechanism is preferably comprised of a torque multiplier, brake and motor. The mechanism can be either hydraulically or electrically controlled remotely from the crane 10.

In operation, the pile rotator 40 of the present invention allows the crane operator to precisely center the pile 28. With reference to FIG. 1, when it is desired to drive a pile at the location identified B, with the crane in the relative position shown, the crane operator will position the lead as shown in that pictorial sketch by manipulation of the booms 16 and 20. The pile will be secured at its upper end in the normal fashion and be placed within the opening 68 of the pile rotator 40 at its lower end. This is facilitated by the gate segment 54. Once the pile is properly positioned within the pile rotator 40, the gate segment 54 will be latched and the pile restrained within the opening 68. The roller guides 66 insure a suitable fit between the pile rotator 40 and the pile 28.

The pile guide 32 is also secured about the pile 28, as shown in FIG. 3. The pile guide is then raised by the crane operator from this lowered position and the upper end of the pile is guided into engagement with the helmet 30. At this point, a pile having a noncircular cross-section will have its orientation rotated by an angle $\alpha$ as shown in FIG. 1. The crane operator then rotates the lower end of pile 28 by rotating the ring beam 50 of the pile rotator 40 through the chain control system described above. Rotation of the bottom of pile 28 continues until the pile 28 is in the proper orientation, and is braked in that position during driving.

Obviously, the pile must be free to rotate throughout its full length. It has been determined that the most efficient means for permitting rotation of the pile is to permit the pile-mating components of both the pile guide and the helmet to rotate in response to rotation of the pile itself. Accordingly, both the pile guide and the helmet include means for permitting rotation of the internal components of each. The precise structure to achieve this is not critical. For example, the pile guide disclosed and claimed in U.S. Pat. No. 3,827,508 can be modified by securing it to a fixture similar to fixture 84 which receives the rotatable ring beam 50 of the pile rotator. This fixture will allow suitable rotation of the pile-mating components of the pile guide when the pile is rotated. Similarly, the helmet 30 may be fabricated with an outer collar, or other suitable means, which permits internal rotation of the pile-mating components thereof. By whatever means are employed, both the pile guide and helmet will be slaved through the pile itself for rotation with rotation of the ring beam.

The present invention permits the driving of a line of piles with minimal movement of the crane. Provided the crane is capable of positioning the lead at a desired location, the pile itself can be properly oriented. And, this substantial advantage is achieved by a simple, yet highly efficient, design for the pile rotator.

While the invention has now been described in terms of certain preferred embodiments, the skilled artisan will appreciate that various changes, substitutions, modifications, and omissions may be made without departing from the spirit thereof. For example, the chain drive for the pile rotator might be replaced by a pair of hydraulic pistons, gears, or other equivalent devices with which those skilled in the art are familiar. Accordingly, it is intended that the scope of the present invention be limited solely by that of the following claims.

What is claimed is:

1. A pile driver assembly for a noncircular pile, comprising: a lead, a hammer assembly supported for longitudinal movement along said lead, a helmet at the lower terminus of said hammer assembly having pile mating components with a noncircular internal configuration for receiving the upper end of the pile, a pile guide supported for longitudinal movement along said lead and having pile mating components with a noncircular internal configuration for receiving the pile intermediately the length thereof, the pile mating components of each of said helmet and pile guide being rotatable in response to rotation of the pile, and a pile rotator supported proximate the lower end of said lead having a noncircular internal configuration for receiving the pile; said pile rotator comprising means for centering and rotating the pile.

2. The invention according to claim 1 wherein said pile rotator includes a ring beam internally configured for receiving and restraining the noncircular pile and drive means for rotating said ring beam, said ring beam including a generally cylindrical member secured for rotation by a fixture, said cylindrical member comprising a pair of spaced plates defining upper and lower guide channels therebetween, and said fixture comprising spaced upper and lower plates defining a fixture channel therebetween; said pile rotator further comprising guide strips secured to the upper and lower fixture plates, said strips projecting within a portion of said guide channels.

3. The invention according to claim 1 wherein said pile rotator includes a ring beam internally configured for receiving and restraining the noncircular pile and drive means for rotating said ring beam.

4. The invention of claim 3, wherein said ring beam comprises a generally cylindrical member secured for rotation by a fixture, and further including insert means for defining a noncircular internal opening therein which corresponds to the cross-section of a pile to be driven.

5. The invention of claim 4, further comprising guide means for confining the movement of said cylindrical member within said fixture to a circular path.

6. The invention of claim 4, wherein said drive means comprise a drive linkage secured to said rotatable member and communicating with drive motor means.

7. The invention of claims 3, 4, or 6, wherein said drive means includes a motor/brake assembly.

* * * * *